US010264888B2

(12) United States Patent
Clark

(10) Patent No.: US 10,264,888 B2
(45) Date of Patent: Apr. 23, 2019

(54) FOLDABLE LOUNGE CHAIR CUSHION

(71) Applicant: Debra Clark, West Islip, NY (US)

(72) Inventor: Debra Clark, West Islip, NY (US)

( * ) Notice: Subject to any disclaimer, the term of this patent is extended or adjusted under 35 U.S.C. 154(b) by 0 days.

(21) Appl. No.: 15/485,825

(22) Filed: Apr. 12, 2017

(65) Prior Publication Data

US 2018/0289163 A1 Oct. 11, 2018

Related U.S. Application Data

(63) Continuation-in-part of application No. 29/600,335, filed on Apr. 11, 2017.

(51) Int. Cl.
*A47C 27/14* (2006.01)
*A47C 7/02* (2006.01)
*A47C 1/14* (2006.01)

(52) U.S. Cl.
CPC ..... *A47C 7/021* (2013.01); *A47C 1/143* (2013.01)

(58) Field of Classification Search
CPC ..... A47C 7/021; A47C 7/425; A47C 7/62; A47C 3/11; A47C 13/00; A47C 4/52; A47C 31/126; A47C 7/022; B60N 2/882; A47D 15/006
See application file for complete search history.

(56) References Cited

U.S. PATENT DOCUMENTS 2,528,768 A * 11/1950 Marsh ..... A47C 3/16 297/109
3,555,581 A * 1/1971 Friant ..... A47C 3/16 5/705
4,188,988 A * 2/1980 Agyagos ..... A45C 3/00 190/2
4,190,918 A * 3/1980 Harvell ..... A47C 4/52 190/1
4,249,267 A * 2/1981 Voss ..... A41F 1/002 2/121
4,654,907 A * 4/1987 Haugaard ..... A45C 3/10 297/17
4,822,309 A * 4/1989 Vandenberg ..... A45C 9/00 297/188.01
4,843,662 A * 7/1989 Handelman ..... A47C 7/021 297/183.5
5,033,133 A * 7/1991 Nissen ..... A47C 7/021 5/653
5,048,975 A * 9/1991 Holbrook ..... A45F 4/02 190/2
D329,957 S * 10/1992 Hartnett ..... 5/653
5,199,120 A * 4/1993 Holmes ..... A45F 4/06 190/2

(Continued)

FOREIGN PATENT DOCUMENTS

WO 1992004846 A1 4/1992
WO 2010093303 A1 8/2010

*Primary Examiner* — Shin H Kim

(74) *Attorney, Agent, or Firm* — Olav M. Underal; IDP Patent Services

(57) ABSTRACT

A foldable lounge chair cushion, including a plurality of connected cushion segments right and left front flaps, right and left rear flaps, a handle that can be hidden in a fold between successive cushion segments, and a rear center flap with a handle aperture, such that the connected cushion segments form a pleated structure, which can be folded-out for use and folded-up for storage and transportation.

18 Claims, 6 Drawing Sheets

Foldable lounge chair cushion

(56) References Cited

U.S. PATENT DOCUMENTS

| | | | | | |
|---|---|---|---|---|---|
| 5,203,041 | A * | 4/1993 | Alonso | A47C 17/82 | 190/2 |
| 5,265,292 | A * | 11/1993 | Underell | A47C 4/52 | 297/380 |
| 5,297,848 | A * | 3/1994 | Grinnell | A47C 7/425 | 297/219.1 |
| 5,466,039 | A * | 11/1995 | Umbrianna | A47C 1/143 | 297/115 |
| D366,800 | S * | 2/1996 | Moore, Jr. | D6/596 | |
| 5,491,851 | A * | 2/1996 | Alonso | A47C 27/001 | 5/420 |
| 5,762,170 | A * | 6/1998 | Shyr | A45C 5/14 | 190/109 |
| D474,934 | S * | 5/2003 | Ildstad | D6/601 | |
| 6,618,883 | B2 * | 9/2003 | Angland | A47C 17/04 | 5/12.1 |
| 6,691,356 | B1 * | 2/2004 | Coma | A47C 4/52 | 5/417 |
| 6,711,766 | B2 * | 3/2004 | Monk | A47B 95/02 | 5/417 |
| D685,211 | S * | 7/2013 | Vega-Woller | D6/596 | |
| 8,578,526 | B1 * | 11/2013 | Rosso | A47C 1/146 | 5/417 |
| 8,899,677 | B2 * | 12/2014 | Hurlburt | A47C 13/00 | 297/217.1 |
| D755,540 | S * | 5/2016 | Schueth | D6/596 | |
| 2008/0178391 | A1 * | 7/2008 | Andrade | A47C 1/146 | 5/705 |

* cited by examiner

Foldable lounge chair cushion

FOLDABLE LOUNGE CHAIR CUSHION

CROSS-REFERENCE TO RELATED APPLICATIONS

This application is a continuation-in-part of U.S. Design application Ser. No. 29/600,335, filed Apr. 11, 2017.

FIELD OF THE INVENTION

The present invention relates generally to the field of lounge chair cushions, and more particularly to methods and systems for lounge chair cushions that are foldable, storable, and transportable.

BACKGROUND OF THE INVENTION

Lounge chairs are popular for use in backyard patios and by pools. However, such cushions are typically cumbersome to remove for storage, and are not convenient for travel.

As such, considering the foregoing, it may be appreciated that there continues to be a need for novel and improved devices and methods for foldable and transportable lounge chair cushions.

SUMMARY OF THE INVENTION

The foregoing needs are met, to a great extent, by the present invention, wherein in aspects of this invention, enhancements are provided to the existing model of lounge chair cushions.

In an aspect, a foldable lounge chair cushion can include:

a plurality of connected cushion segments, such that the connected cushion segments can be connected with cushion connections that shift successively from lower cushion segment connections to upper cushion segment connections, and from upper cushion segment connections to lower cushion segment connections;

such that the connected cushion segments form a pleated structure, which can be configurable to be folded-out and configurable to be folded-up.

In a related aspect, the foldable lounge chair cushion can further include:

a) a right front flap, which can be connected along a right edge of a front cushion segment;

b) a left front flap, which can be connected along a left edge of the front cushion segment;

c) a right rear flap, which can be connected along a right edge of a rear cushion segment;

d) a left rear flap, which can be connected along a left edge of the rear cushion segment;

such that when the foldable lounge chair cushion is in a folded-out state, the right and left front flaps and the right and left rear flaps can be configured to be folded behind the plurality of connected cushion segments, whereby the right and left front flaps and the right and left rear flaps can be at least partially hidden behind the plurality of connected cushion segments;

such that when the foldable lounge chair cushion is in a folded-up state, the right front flap can be configured to be detachably connectable to the right rear flap and the left front flap can be configured to be detachably connectable to the left rear flap.

In another related aspect, the foldable lounge chair cushion can further include:

a rear center flap, which can be connected to a rear end of a rear cushion segment of the plurality of connected cushion segments, the rear center flap including:

a handle aperture, which can be configured to allow the handle to protrude through the handle aperture, when the foldable lounge chair cushion is in a folded-up state;

such that when the foldable lounge chair cushion is in a folded-out state, the rear center flap can be folded behind the plurality of connected cushion segments, whereby the rear center flap can be partially hidden behind the plurality of connected cushion segments;

such that when the foldable lounge chair cushion is in a folded-up state, the rear center flap can be folded around a top of the folded-up plurality of connected cushion segments, such that an outer end of the rear center flap can be detachably connected to an upper side of the front cushion segment, which is a front of the folded-up plurality of connected cushion segments.

In yet another related aspect, the foldable lounge chair cushion can further include:

a rear center flap, which can be connected to a rear end of a rear cushion segment of the plurality of connected cushion segments, the rear center flap including:

a handle aperture, which can be configured to allow the handle to protrude through the handle aperture, when the foldable lounge chair cushion is in a folded-up state;

such that when the foldable lounge chair cushion is in a folded-out state, the rear center flap can be folded behind the plurality of connected cushion segments, whereby the rear center flap can be partially hidden behind the plurality of connected cushion segments;

such that when the foldable lounge chair cushion is in a folded-up state, the rear center flap can be folded around a top of the folded-up plurality of connected cushion segments, such that an outer end of the rear center flap can be detachably connected to an upper side of the front cushion segment, which is a front of the folded-up plurality of connected cushion segments.

In a further related aspect, the foldable lounge chair cushion can further include:

a handle, which is connected to the plurality of cushion segments, between successive cushion segments;

wherein the rear center flap can further include:

a handle aperture, which can be configured to allow the handle to protrude through the handle aperture when the foldable lounge chair cushion is in a folded-up state;

such that when the foldable lounge chair cushion is in the folded-up state and the rear center flap is folded around the top of the folded-up plurality of connected cushion segments, the handle can protrude through the handle aperture.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
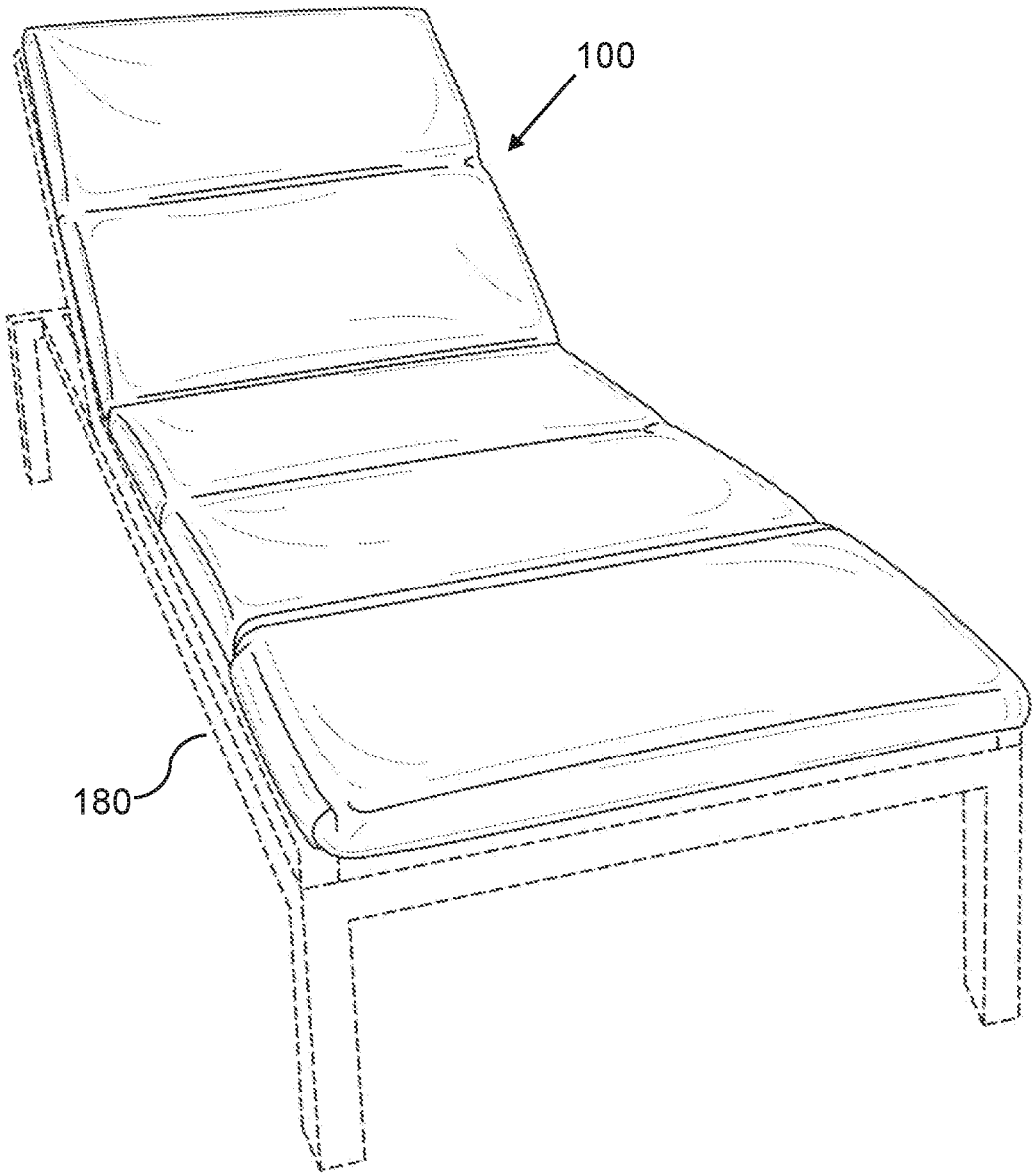
FIG. 1 is a perspective view of a foldable lounge chair cushion that is positioned on a lounge chair, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a foldable lounge chair cushion 100 for installation on a lounge chair 180 with reference to FIG. 1, in such manner that like reference numerals refer to like components throughout; a convention that we shall employ for the remainder of this specification.

Figure 2:
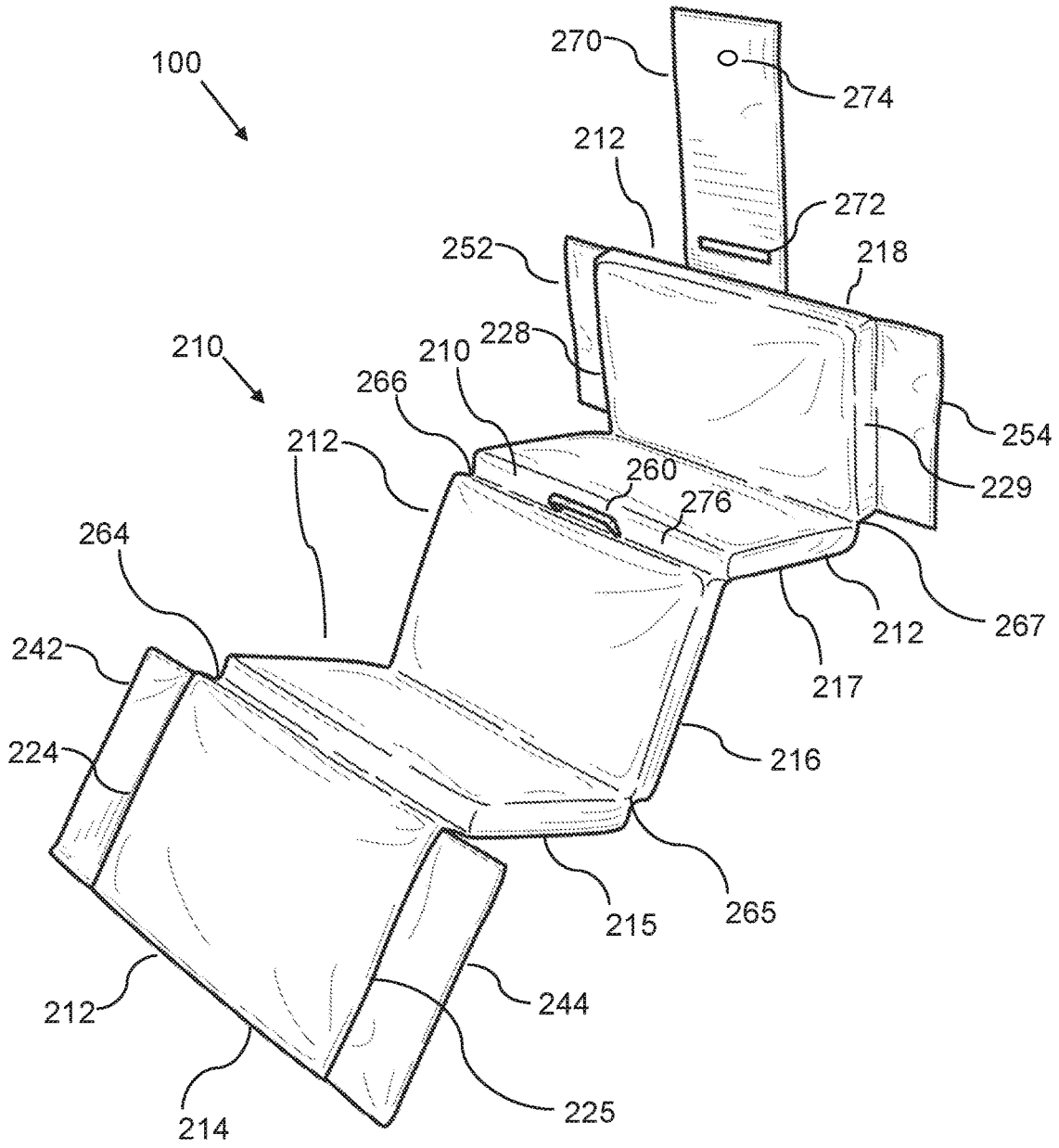
FIG. 2 is a perspective view of a foldable lounge chair cushion in a partially folded-out state, according to an embodiment of the invention.
Figure 3:
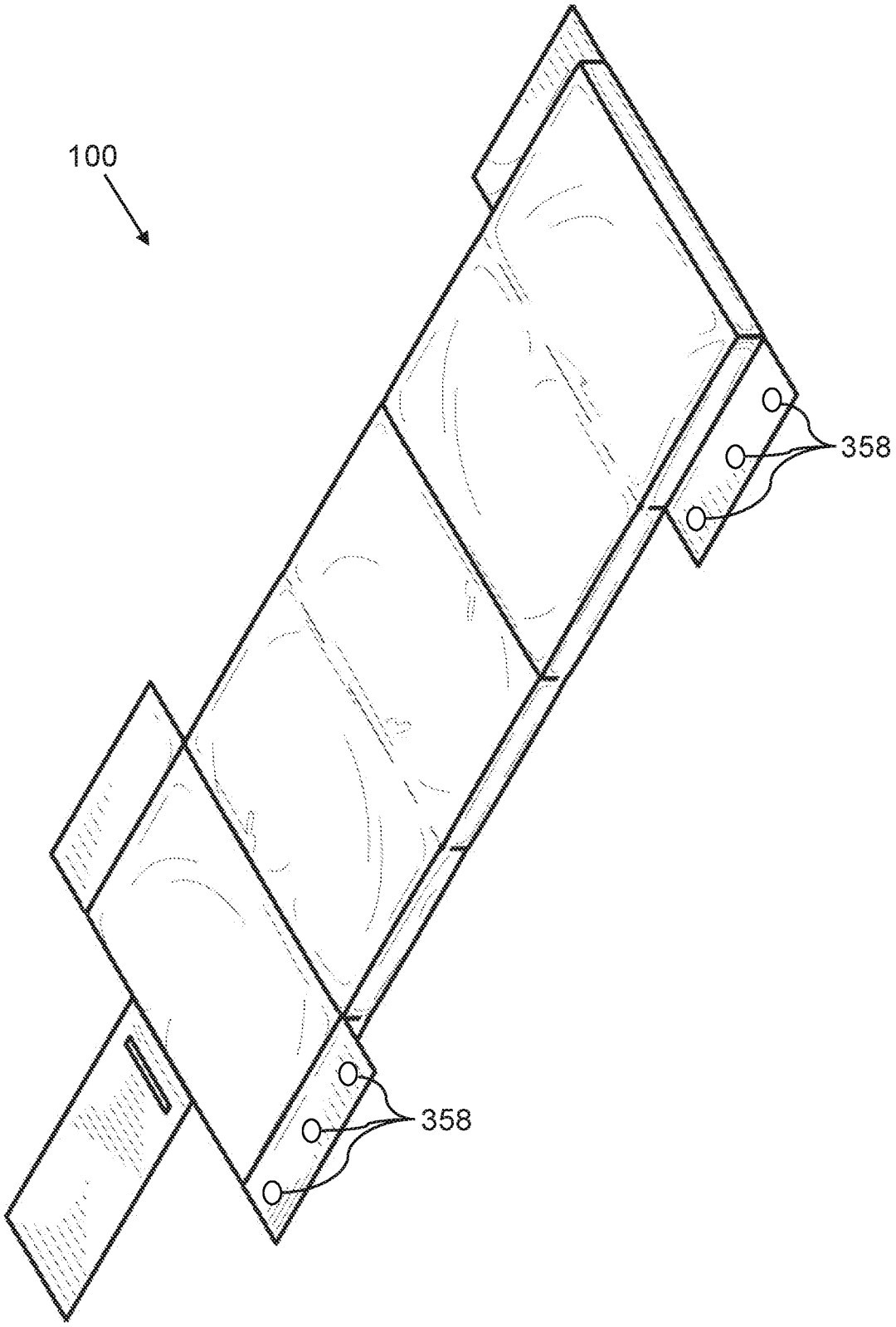
FIG. 3 is a perspective view of a foldable lounge chair cushion in a folded-out state, according to an embodiment of the invention.
Figure 4:
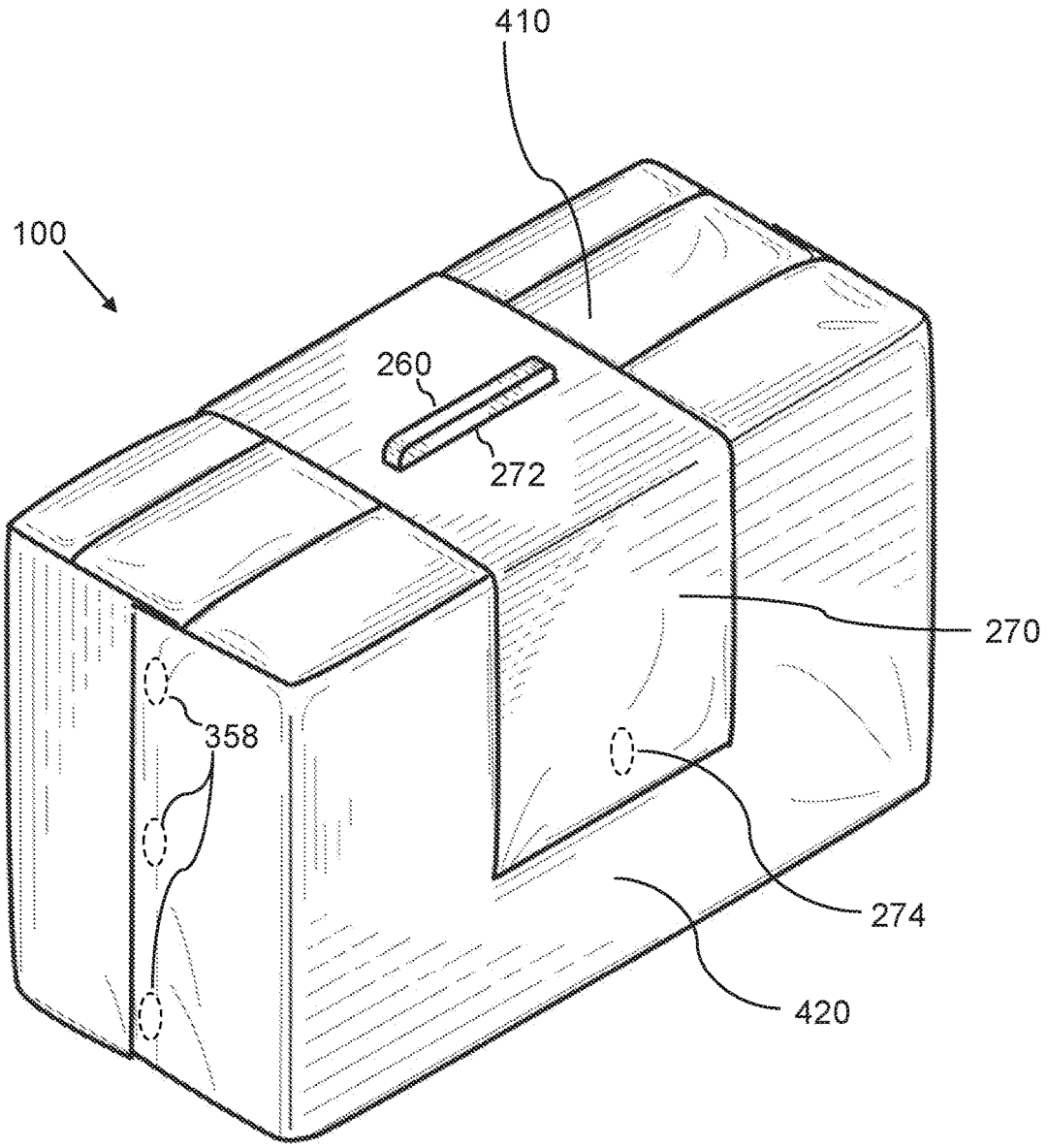
FIG. 4 is a perspective view of a foldable lounge chair cushion in a folded-up state, according to an embodiment of the invention.

In an embodiment, as shown in FIGS. 1 and 2, a foldable lounge chair cushion 100 can include:

a) a plurality 210 of connected cushion segments 212, such that:

i. a first/front cushion segment 214 is connected along a lower rear end to a lower front end of a second cushion 215; and ii. a last/rear cushion segment 218 is connected along an upper front end to a preceding/next to last cushion segment 217;

such that the connected cushion segments 214 215 216 217 218 are connected with cushion connections 264 265 266 267 that shift successively from lower cushion segment connections 264 266 to upper cushion segment connections 265 267, and from upper cushion segment connections 265 267 to lower cushion segment connections 264 266, such that first successive cushion segments 214 215 are connected along lower or upper ends and second successive cushion segments 215 216 are connected along opposite upper or lower ends respectively;

such that the plurality of cushion segments form a pleated structure, which can be folded flat, i.e. in a folded-out state, as shown in FIG. 3, and folded up, i.e. in a folded-up stated, such as shown in FIG. 4. FIG. 2 shows the plurality of cushion segments in a partially folded-up/unfolded state;

b) a right front flap 242, which can be connected along a right edge 224 of the front cushion segment 214;

c) a left front flap 244, which can be connected along a left edge 225 of the front cushion segment 214;

d) a right rear flap 252, which can be connected along a right edge 228 of the rear cushion segment 218;

e) a left rear flap 254, which can be connected along a left edge 229 of the rear cushion segment 218;

f) a handle 260, which is connected to the plurality of cushion segments, between successive cushion segments 216 217; and g) a rear center flap 270, which can be connected to a rear end of the rear cushion segment 218, the rear center flap 270 further comprising:

a handle aperture 272, which can be elongated, which is configured to allow the handle 260 to protrude through the handle aperture 272 when the foldable lounge chair cushion 100 is in a folded-up state, as shown in FIG. 4;

wherein, when the foldable lounge chair cushion 100 is in a folded-out state, as shown in FIG. 1, the right and left front flaps 242 244, the right and left rear flaps 252 254, and the rear center flap 270 can be folded behind, and thereby partially hidden behind, the plurality 210 of connected cushion segments 212;

wherein, when the foldable lounge chair cushion 100 is in a folded-up state, as shown in FIG. 4, the right front flap 242 can be detachably connected to the right rear flap 252, the left front flap 244 can be detachably connected to the left rear flap 254, and the rear center flap 270 can be folded around a top 410 of the folded-up plurality 210 of connected cushion segments 212, such that an outer end 274 of the rear center flap 270 is detachably connected to an upper side of the front cushion segment 214, which is a front 420 of the folded-up plurality 210 of connected cushion segments 212, such that the handle 250 protrudes through the handle aperture 272.

In a related embodiment, the right and left front flaps 242 244 can be detachably connectable to respectively the right and left rear flap 252 254 with buttons 358, hook and loop fasteners 358, magnets connectors 358, or other well-known connectors. The magnet connectors 358 can be hidden inside a surface of the flaps 242 244 252 254, such that the magnet connectors 358 are not externally visible.

In another related embodiment, the outer end 274 of the rear center flap 270 can be detachably connectable to an upper side of the front cushion segment 214 with buttons 274, hook and loop fastener 274, magnet connectors 274, or other well-known connectors for use in bags and suitcases.

In yet a related embodiment, as shown in FIG. 1, the handle can be configured to be hidden in an upward opening fold 276 between successive cushion segments 216 217 that are connected in a lower cushion segment connection 266 along lower ends of the successive cushion segments 216 217, when the foldable lounge chair cushion 100 is in a folded-out state.

In another related embodiment, as shown in FIGS. 2 and 3:

a) the right front flap 242 can be connected along an upper side of the right edge 224 of the front cushion segment 214;

b) the left front flap 244 can be connected along an upper side of the left edge 225 of the front cushion segment 214;

c) the right rear flap 252 can be connected along a lower side of the right edge 228 of the rear cushion segment 218;

d) the left rear flap 254 can be connected along a lower side of the left edge 229 of the rear cushion segment 218; and e) the rear center flap 270 can be connected to a lower side of the rear end of the rear cushion segment 218.

In related embodiments the plurality 210 of connected cushion segments 212 can include, three, five, seven, or a larger odd number of connected cushion segments 212. In the various embodiments shown in FIGS. 1-6, the foldable lounge chair cushion 100 is configured with five connected cushion segments 212.

Figure 5:
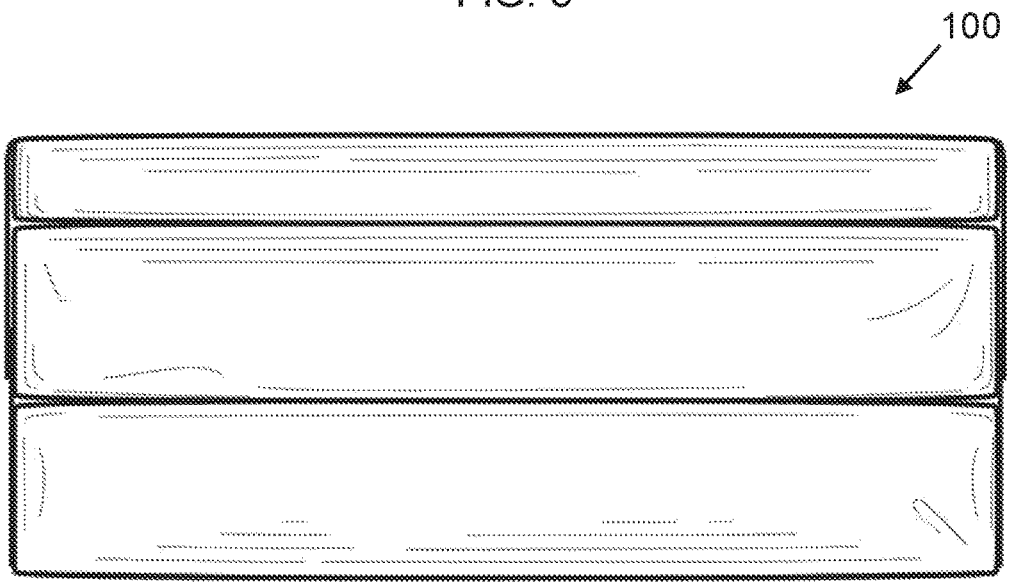
FIG. 5 is a bottom view of a foldable lounge chair cushion in a folded-up state, according to an embodiment of the invention.
Figure 6:
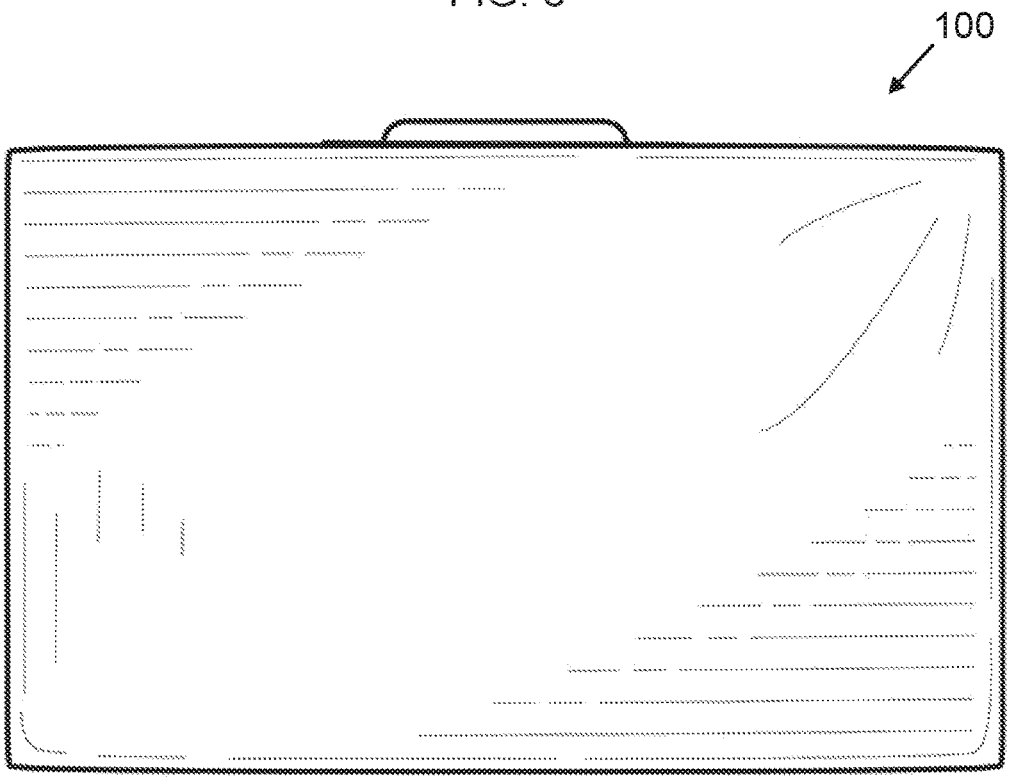
FIG. 6 is a rear view of a foldable lounge chair cushion in a folded-up state, according to an embodiment of the invention.
Figure 7:
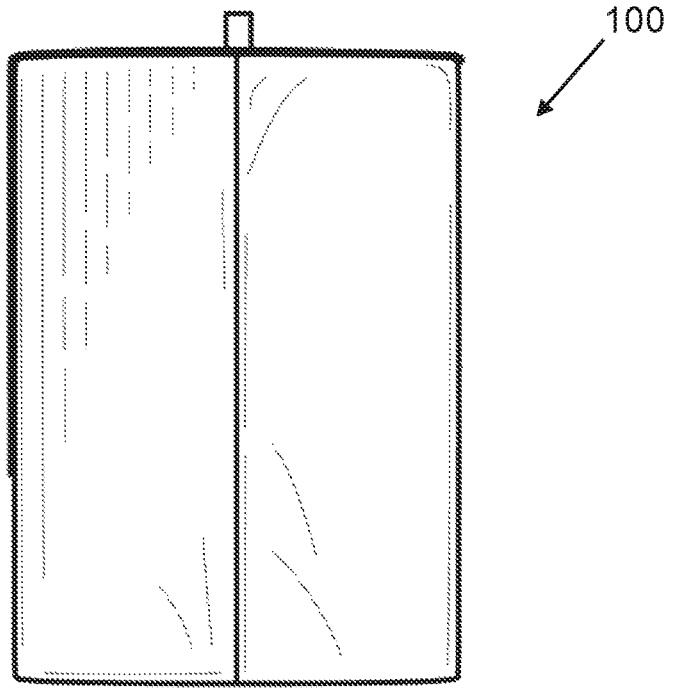
FIG. 7 is a right side view of a foldable lounge chair cushion in a folded-up state, according to an embodiment of the invention.

In related embodiments, FIGS. 5, 6, and 7 show respectively bottom, rear, and right side views of the foldable lounge chair cushion 100 in a folded-up state.

Here has thus been described a multitude of embodiments of the foldable lounge chair cushion 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A foldable lounge chair cushion, comprising:

a) a plurality of connected cushion segments;

b) a right front flap, which is connected along a right edge of a front cushion segment;

c) a left front flap, which is connected along a left edge of the front cushion segment;

d) a right rear flap, which is connected along a right edge of a rear cushion segment; and e) a left rear flap, which is connected along a left edge of the rear cushion segment;

such that the connected cushion segments are connected with cushion connections that shift successively from lower cushion segment connections to upper cushion segment connections, and from upper cushion segment connections to lower cushion segment connections;

such that the connected cushion segments form a pleated structure, which is configurable to be folded-out and configurable to be folded-up;

wherein, when the foldable lounge chair cushion is in a folded-out state, the right and left front flaps and the right and left rear flaps are configured to be folded behind the plurality of connected cushion segments, whereby the right and left front flaps and the right and left rear flaps are partially hidden behind the plurality of connected cushion segments;

wherein, when the foldable lounge chair cushion is in a folded-up state, the right front flap is configured to be detachably connectable to the right rear flap and the left front flap is configured to be detachably connectable to the left rear flap.

2. The foldable lounge chair cushion of claim 1, wherein:

a) a first cushion segment of the plurality of connected cushion segments is connected along a lower rear end to a lower front end of a second cushion segment of the plurality of connected cushion segments; and b) a last cushion segment of the plurality of connected cushion segments is connected along an upper front end to a next to last cushion segment of the plurality of connected cushion segments.

3. The foldable lounge chair cushion of claim 1, further comprising:

a handle, which is connected to the plurality of cushion segments, between successive cushion segments; and a rear center flap, which is connected to a rear end of a rear cushion segment of the plurality of connected cushion segments, the rear center flap comprising:

a handle aperture, which is configured to allow the handle to protrude through the handle aperture, when the foldable lounge chair cushion is in a folded-up state;

wherein, when the foldable lounge chair cushion is in a folded-out state, the rear center flap is configured to be folded behind the plurality of connected cushion segments, whereby the rear center flap is partially hidden behind the plurality of connected cushion segments;

wherein, when the foldable lounge chair cushion is in a folded-up state, the rear center flap is configured to be folded around a top of the folded-up plurality of connected cushion segments, such that an outer end of the rear center flap is detachably connected to an upper side of the front cushion segment, which is a front of the folded-up plurality of connected cushion segments.

4. The foldable lounge chair cushion of claim 1, further comprising:

a handle, which is connected to the plurality of cushion segments, between successive cushion segments.

5. The foldable lounge chair cushion of claim 1, further comprising:

a handle, which is connected to the plurality of cushion segments, between successive cushion segments; and a rear center flap, which is connected to a rear end of a rear cushion segment of the plurality of connected cushion segments, the rear center flap comprising:

a handle aperture, which is configured to allow the handle to protrude through the handle aperture, when the foldable lounge chair cushion is in a folded-up state;

wherein, when the foldable lounge chair cushion is in the folded-up state and the rear center flap is folded around the top of the folded-up plurality of connected cushion segments, the handle protrudes through the handle aperture.

6. The foldable lounge chair cushion of claim 3, wherein the successive cushion segments are connected in a lower cushion segment connection along lower ends of the successive cushion segments;

wherein, when the foldable lounge chair cushion is in the folded-out state, the handle is configured to be hidden in an upward opening fold between the successive cushion segments.

7. The foldable lounge chair cushion of claim 1, wherein the plurality of connected cushion segments is five connected cushion segments.

8. The foldable lounge chair cushion of claim 3, wherein the rear center flap is connected to a lower side of the rear end of the rear cushion segment.

9. The foldable lounge chair cushion of claim 1, further comprising a plurality of magnet connectors, wherein the right front flap is detachably connectable to the right rear flap and the left front flap is configured detachably connectable to the left rear flap with the plurality of magnet connectors.

10. The foldable lounge chair cushion of claim 3, further comprising magnet connectors, wherein the outer end of the rear center flap is detachably connected to the upper side of the front cushion segment with the magnet connectors.

11. The foldable lounge chair cushion of claim 1, wherein:

a) the right front flap is connected along an upper side of the right edge of the front cushion segment;

b) the left front flap is connected along an upper side of the left edge of the front cushion segment;

c) the right rear flap is connected along a lower side of the right edge of the rear cushion segment; and d) the left rear flap is connected along a lower side of the left edge of the rear cushion segment.

12. A foldable lounge chair cushion, comprising:

a plurality of connected cushion segments;

a handle, which is connected to the plurality of cushion segments, between successive cushion segments; and a rear center flap, which is connected to a rear end of a rear cushion segment of the plurality of connected cushion segments, the rear center flap comprising:

a handle aperture, which is configured to allow the handle to protrude through the handle aperture, when the foldable lounge chair cushion is in a folded-up state;

such that the connected cushion segments are connected with cushion connections, such that the connected cushion segments form a pleated structure, which is configurable to be folded-out and configurable to be folded-up;

wherein, when the foldable lounge chair cushion is in the folded-up state and the rear center flap is folded around the top of the folded-up plurality of connected cushion segments, the handle protrudes through the handle aperture.

13. The foldable lounge chair cushion of claim 12, wherein the connected cushion segments are connected with cushion connections that shift successively from lower cushion segment connections to upper cushion segment connections, and from upper cushion segment connections to lower cushion segment connections.

14. The foldable lounge chair cushion of claim 12, wherein:

a) a first cushion segment of the plurality of connected cushion segments is connected along a lower rear end to a lower front end of a second cushion segment of the plurality of connected cushion segments; and b) a last cushion segment of the plurality of connected cushion segments is connected along an upper front end to a next to last cushion segment of the plurality of connected cushion segments.

15. The foldable lounge chair cushion of claim 12, further comprising:

a) a right front flap, which is connected along a right edge of a front cushion segment;

b) a left front flap, which is connected along a left edge of the front cushion segment;

c) a right rear flap, which is connected along a right edge of a rear cushion segment; and d) a left rear flap, which is connected along a left edge of the rear cushion segment;

wherein, when the foldable lounge chair cushion is in a folded-out state, the right and left front flaps and the right and left rear flaps are configured to be folded behind the plurality of connected cushion segments, whereby the right and left front flaps and the right and left rear flaps are partially hidden behind the plurality of connected cushion segments;

wherein, when the foldable lounge chair cushion is in a folded-up state, the right front flap is configured to be detachably connectable to the right rear flap and the left front flap is configured to be detachably connectable to the left rear flap.

16. The foldable lounge chair cushion of claim 12, further comprising:

a rear center flap, which is connected to a rear end of a rear cushion segment of the plurality of connected cushion segments, the rear center flap comprising:

a handle aperture, which is configured to allow the handle to protrude through the handle aperture, when the foldable lounge chair cushion is in a folded-up state;

wherein, when the foldable lounge chair cushion is in a folded-out state, the rear center flap is configured to be folded behind the plurality of connected cushion segments, whereby the rear center flap is partially hidden behind the plurality of connected cushion segments;

wherein, when the foldable lounge chair cushion is in a folded-up state, the rear center flap is configured to be folded around a top of the folded-up plurality of connected cushion segments, such that an outer end of the rear center flap is detachably connected to an upper side of the front cushion segment, which is a front of the folded-up plurality of connected cushion segments.

17. The foldable lounge chair cushion of claim 12, further comprising:

a handle, which is connected to the plurality of cushion segments, between successive cushion segments.

18. The foldable lounge chair cushion of claim 15, wherein the successive cushion segments are connected in a lower cushion segment connection along lower ends of the successive cushion segments;

wherein, when the foldable lounge chair cushion is in the folded-out state, the handle is configured to be hidden in an upward opening fold between the successive cushion segments.

* * * * *